US006447864B2

(12) United States Patent
Johnson et al.

(10) Patent No.: US 6,447,864 B2
(45) Date of Patent: Sep. 10, 2002

(54) SHEET MATERIAL HAVING WEAKNESS ZONES AND A SYSTEM FOR DISPENSING THE MATERIAL

(75) Inventors: Douglas W. Johnson; Dale T. Gracyalny, both of Appleton; Thomas N. Kershaw; John R. Moody, both of Neenah, all of WI (US)

(73) Assignee: Fort James Corporation, Richmond, VA (US)

( * ) Notice: Subject to any disclaimer, the term of this patent is extended or adjusted under 35 U.S.C. 154(b) by 0 days.

(21) Appl. No.: 09/739,239

(22) Filed: Dec. 19, 2000

Related U.S. Application Data

(63) Continuation of application No. 09/076,724, filed on May 13, 1998, now Pat. No. 6,228,454, which is a continuation-in-part of application No. 09/017,482, filed on Feb. 2, 1998, now abandoned.

(51) Int. Cl.[7] ..... B32B 3/10
(52) U.S. Cl. ..... 428/43; 221/33
(58) Field of Search ..... 428/43; 225/4; 221/33

(56) References Cited

U.S. PATENT DOCUMENTS

| | | | |
|---|---|---|---|
| 390,328 | A | 10/1888 | Wheeler |
| 1,026,128 | A | 4/1912 | Rydquist |
| 1,414,443 | A | 5/1922 | Steiner |
| 2,067,760 | A | 1/1937 | Harvey |

(List continued on next page.)

FOREIGN PATENT DOCUMENTS

| | | |
|---|---|---|
| CA | 1121769 | 4/1982 |
| CA | 1137935 | 12/1982 |
| CA | 1154411 | 9/1983 |
| CA | 1117917 | 2/1984 |

(List continued on next page.)

*Primary Examiner*—Alexander S. Thomas
(74) *Attorney, Agent, or Firm*—Finnegan, Henderson, Farabow, Garrett & Dunner, L.L.P.

(57) ABSTRACT

Dispensable sheet material includes opposite side edges spaced apart from one another to define the overall width of the sheet material. Zones of weakness are spaced along the sheet material. Adjacent zones of weakness are spaced apart by a distance of from about 50% to about 200% of the overall width of the sheet material to divide the sheet material into a plurality of sheet material segments. Each of the zones of weakness comprises a plurality of perforations and frangible sheet material portions. Each of the frangible sheet material portions has a width of from about 0.3 mm to about 1.8 mm. The total width of the frangible sheet portions in each zone of weakness is from about 10% to about 30% of the overall width of the sheet material. The sheet material has an elasticity in the dispensing direction of from about 4% to about 20%. The sheet material has a dry tensile strength in the dispensing direction of from about 4,000 grams per 3 inches of width to about 12,000 grams per 3 inches of width. The sheet material has a wet tensile strength in the weakest direction, typically, a direction orthogonal to the dispensing direction, of at least about 900 grams per 3 inches of width. In addition, the sheet material has a tensile ratio of less than about 2.0.

A dispensing system includes a dispenser defining an interior for containing the sheet material and an outlet for allowing sheet material to be dispensed from the interior of the housing.

69 Claims, 5 Drawing Sheets

U.S. PATENT DOCUMENTS 2,299,301 A 10/1942 Britt et al.
2,328,109 A 8/1943 Thompson
2,334,689 A 11/1943 Wooster
2,738,934 A 3/1956 Dobkin
2,758,800 A 8/1956 McCants
2,806,591 A 9/1957 Appleton
2,924,494 A 2/1960 Sloier
2,930,664 A 3/1960 Liebisch
2,943,777 A 7/1960 Dvoracek
2,946,636 A 7/1960 Penney
3,073,541 A 1/1963 Layton et al.
3,107,957 A 10/1963 Batlas et al.
3,126,234 A 3/1964 Batlas et al.
3,163,446 A 12/1964 Muncy
3,217,953 A 11/1965 Bahnsen
3,291,354 A 12/1966 Ziebarth
3,294,460 A 12/1966 Wooster et al.
3,319,855 A 5/1967 Tucker et al.
3,438,589 A 4/1969 Jespersen
3,628,743 A 12/1971 Bastian et al.
3,647,158 A 3/1972 Feder
3,672,552 A 6/1972 Krueger et al.
3,690,580 A 9/1972 Jespersen
3,700,181 A 10/1972 Diring et al.
3,770,172 A 11/1973 Nystrand et al.
3,770,222 A 11/1973 Jespersen
3,771,739 A 11/1973 Nelson
3,828,996 A 8/1974 Warren
3,829,185 A 8/1974 Lloyd
3,851,810 A 12/1974 Jespersen
3,865,295 A 2/1975 Okamura
3,865,395 A 2/1975 Mathers et al.
3,917,191 A 11/1975 Graham, Jr. et al.
4,010,909 A 3/1977 Bastian
4,067,509 A 1/1978 Graham, Jr. et al.
4,106,684 A 8/1978 Hartbauer et al.
4,108,389 A 8/1978 Womack
4,137,805 A 2/1979 DeLuca et al.
4,142,431 A 3/1979 Jespersen
4,165,138 A 8/1979 Hedge et al.
4,199,090 A 4/1980 Reed
4,203,562 A 5/1980 DeLuca et al.
4,206,858 A 6/1980 DeLuca et al.
4,236,679 A 12/1980 Jespersen
4,284,402 A 8/1981 Sheets et al.
4,307,638 A 12/1981 DeLuca et al.
4,307,639 A 12/1981 DeLuca
4,317,547 A 3/1982 Graham, Jr. et al.
4,340,195 A 7/1982 DeLuca
4,358,169 A 11/1982 Filipowicz et al.
4,378,912 A 4/1983 Perrin et al.
4,396,163 A 8/1983 Graham, Jr. et al.
4,403,748 A 9/1983 Cornell
4,404,880 A 9/1983 DeLuca
4,441,392 A 4/1984 DeLuca
4,457,964 A 7/1984 Kaminstein
4,487,375 A 12/1984 Rasmussen et al.
4,520,968 A 6/1985 Shpigelman
4,522,346 A 6/1985 Jespersen
4,552,315 A 11/1985 Granger
4,601,938 A 7/1986 Deacon et al.
4,611,768 A 9/1986 Voss et al.
4,616,994 A 10/1986 Tomlinson
4,620,184 A 10/1986 Nedstedt
4,627,117 A 12/1986 Morishita
4,634,192 A 1/1987 Fielding
4,659,028 A 4/1987 Wren
4,712,461 A 12/1987 Ramussen
4,732,306 A 3/1988 Jesperson
4,756,485 A 7/1988 Bastian et al.
4,776,320 A 10/1988 Ripka et al.
4,807,824 A 2/1989 Gains et al.
4,844,361 A 7/1989 Granger
4,846,412 A 7/1989 Morand
4,856,724 A 8/1989 Jespersen
D306,384 S 3/1990 Morand
4,944,466 A 7/1990 Jespersen
4,974,783 A 12/1990 Campbell
5,009,313 A 4/1991 Morand
5,041,317 A 8/1991 Greyvenstein
5,048,386 A 9/1991 DeLuca et al.
5,058,792 A 10/1991 Morand
D321,803 S 11/1991 Dawson
D324,618 S 3/1992 Morand
D324,969 S 3/1992 Morand
5,100,075 A 3/1992 Morand
D325,142 S 4/1992 Morand
5,131,903 A 7/1992 Levine et al.
5,135,179 A 8/1992 Morano
5,172,840 A 12/1992 Bloch et al.
5,174,518 A 12/1992 Hongo et al.
5,205,454 A 4/1993 Schutz et al.
5,211,308 A 5/1993 Decker et al.
5,215,211 A 6/1993 Eberle
5,219,092 A 6/1993 Morand
5,236,753 A 8/1993 Gaggero et al.
D339,705 S 9/1993 Howard et al.
5,244,161 A 9/1993 Wirtz-Odenthal
D340,822 S 11/1993 Morand
5,266,371 A 11/1993 Sugii et al.
D341,970 S 12/1993 Brandenburg
D342,407 S 12/1993 Morand
5,271,574 A 12/1993 Formon et al.
5,288,032 A 2/1994 Boone et al.
5,294,192 A 3/1994 Omdoll et al.
D347,135 S 5/1994 Morand
5,318,210 A 6/1994 Morand
5,335,811 A 8/1994 Morand
5,375,785 A 12/1994 Boone et al.
D356,707 S 3/1995 Morand
5,400,982 A 3/1995 Collins
D357,150 S 4/1995 Morand
5,441,189 A 8/1995 Formon et al.
D363,628 S 10/1995 McCanless
5,526,973 A 6/1996 Boone et al.
5,549,218 A 8/1996 Asmussen
5,558,302 A 9/1996 Jesperson
5,562,964 A 10/1996 Jones
5,566,873 A 10/1996 Guido
5,573,318 A 11/1996 Arabian et al.
5,604,992 A 2/1997 Robinson
5,630,526 A 5/1997 Moody
5,645,244 A 7/1997 Moody
5,676,331 A 10/1997 Weber
5,690,299 A 11/1997 Perrin et al.
5,697,576 A 12/1997 Bloch et al.
5,704,566 A 1/1998 Schulz et al.
6,228,454 B1 5/2001 Johnson et al.

FOREIGN PATENT DOCUMENTS

CA 1176609 10/1984
CA 1211740 9/1986
CA 1230865 12/1987
CA 2011272 3/1990
CA 1269351 5/1990
CA 1288395 9/1991
CA 2014209 10/1991
CA 2036306 2/1992
CA 1301712 5/1992
CA 2039382 9/1992
CA 1311222 12/1992

| | | |
|---|---|---|
| CA | 2073931 | 1/1993 |
| CA | 2116671 | 3/1993 |
| CA | 2067970 | 8/1993 |
| CA | 2090776 | 11/1993 |
| CA | 2075140 | 12/1993 |
| CA | 2092585 | 5/1994 |
| CA | 2154159 | 8/1994 |
| CA | 2183524 | 10/1995 |
| CA | 2162745 | 6/1996 |
| CA | 2218427 | 8/1996 |
| CA | 2199092 | 9/1997 |
| CA | 2212940 | 4/1998 |
| DE | 2706234 A1 | 8/1978 |
| GB | 1325923 | 8/1973 |

SHEET MATERIAL HAVING WEAKNESS ZONES AND A SYSTEM FOR DISPENSING THE MATERIAL

This is a continuation of U.S. patent application Ser. No. 09/076,724, filed May 13, 1998 U.S. Pat. No. 6,228,454, which is a continuation-in-part of U.S. patent application Ser. No. 09/017,482, filed Feb. 2, 1998 (abandoned), all of which are incorporated herein by reference.

BACKGROUND OF THE INVENTION

1. Field of the Invention

The present invention relates to perforated sheet material and a dispensing system for dispensing the sheet material. More particularly, the present invention relates to perforated sheet material and a dispensing system for dispensing individual segments of the sheet material from a dispenser.

2. Description of Related Art

A number of different types of sheet materials can be dispensed from a source. Typically, these materials are wound into a roll either with or without a core to provide a maximum amount of material in a relatively small amount of space. Some examples of these materials include paper towels, tissue, wrapping paper, aluminum foil, wax paper, plastic wrap, and the like.

For example, paper towels are either perforated or are not perforated. Non-perforated paper towels are typically dispensed from dispensers by rotating a crank or moving a lever each time the user desires to remove material from the dispenser. Although these types of dispensers are effective at dispensing individual segments from sheets of material, a user must make physical contact with the crank or lever each time the user desires to dispense the sheet material from the dispenser. For example, during a single day in an extremely busy washroom, hundreds or even thousands of users may physically contact a dispenser to dispense paper toweling therefrom. This leads to possible transfer of germs and a host of other health concerns associated with the spread of various contaminants from one user to another.

Attempts have been made to limit the amount of user contact with a dispenser. For example, U.S. Pat. No. 5,630,526 to Moody, U.S patent application Ser. No. 08/851,937, filed on May 6, 1997, U.S. Pat. No. 5,868,275 and U.S. Pat. No. 5,335,811 to Morand, the entire disclosures of which are incorporated herein by reference, disclose systems for dispensing individual segments of sheet material from a roll of sheet material having perforated tear lines separating the individual segments. Pulling an end-most segment of the sheet material tears the end-most segment away from the remaining material along a perforated tear line separating the end-most segment from the remainder of the material. Dispensing systems of this type are known as "touch-less" because normally the user is not required to touch any portion of the dispenser itself. During dispensing, the user grasps only an end portion of the sheet material with one hand or both hands and pulls the sheet material from the dispenser.

With these touch-less types of dispensing systems, on any given attempt the result may fail to meet some of the desired criteria, and thus, cause some level of dissatisfaction. For example, a sheet may fail to separate fully along the first perforation tear line resulting in the dispensing of multiple sheets. In addition, the remaining sheet material end portion may not extend a sufficient distance from the dispenser outlet, requiring a user to subsequently dispense sheet material while touching the dispenser and thereby defeating its purpose. Alternatively, the remaining end portion may extend so far as to be unsightly and more susceptible to soiling. Lastly, the user may obtain substantially less than a full sheet of material when the tensioning forces applied by the dispenser in order to initiate separation along the perforation tear lines are greater than the strength of the material at the user/material interface. This last type of failure is known as tabbing.

Tabbing occurs more frequently when the sheet material is an absorbent material, such as a paper towel, and when the user grasps this absorbent material with one or more wet hands. Typically, the wet strength of such materials is less than 50% of the dry strength, and, more typically, is 15% to 30% of the dry strength. Thus, when the sum of the tensioning forces exerted on a sheet of absorbent material by a user with wet hands exceeds the wet strength of the material, tabbing is likely to occur. Further, the strength of most sheet materials, wet or dry, is not typically equal in all directions, but typically weaker in the cross machine direction, where machine direction refers to the manufacturing process orientation in the plane of the web and cross machine direction is orthogonal in the plane of the web to the process orientation.

Thus, it is desired to improve reliability of dispensing such that the user obtains a single, fully intact sheet which has separated cleanly and completely from the remaining material along the perforated tear line and where a sufficient length, typically about 2 to 4 inches, of the remaining end portion of sheet material extends from the outlet of the dispenser so as to be available for subsequent dispensing.

In light of the foregoing, there is a need in the art for improved sheet material and an improved dispensing system which increases reliability of single sheet dispensing of sheet material.

SUMMARY OF THE INVENTION

Accordingly, the present invention is directed to sheet material, a dispensing system, and a method that substantially obviate one or more of the limitations of the related art. To achieve these and other advantages and in accordance with the purposes of the invention, as embodied and broadly described herein, the invention in one aspect includes dispensable sheet material. The sheet material includes wet-formed sheet material having opposite side edges spaced apart from one another to define the overall width of the sheet material and zones of weakness spaced along the sheet material. The zones of weakness include a plurality of perforations and frangible sheet material portions. Each of the zones of weakness has a strength equivalent to that of a perforated tear line having a total width of the frangible sheet portions of from about 10% to about 30% of the overall width of the sheet material. The sheet material has an elasticity in the dispensing direction of from about 4% to about 20%. The sheet material has a dry tensile strength in the dispensing direction of from about 4,000 grams per 3 inches of width to about 12,000 grams per 3 inches of width. The sheet material has a wet tensile strength in the weakest direction, preferably in a direction orthogonal to the dispensing direction, of at least about 900 grams per 3 inches of width.

In another aspect, the present invention includes dispensable sheet material including dry-formed sheet material having opposite side edges spaced apart from one another to define the overall width of the sheet material. The sheet material includes zones of weakness spaced along the sheet material. The zones of weakness include a plurality of perforations and frangible sheet material portions. Each of the zones of weakness has a strength equivalent to that of a perforated tear line having a total width of the frangible sheet portions of from about 10% to about 30% of the overall width of the sheet material. The sheet material has an elasticity in the dispensing direction of from about 4% to about 20%. The sheet material has a dry tensile strength in the dispensing direction of from about 4,000 grams per 3 inches of width to about 12,000 grams per 3 inches of width.

In another aspect, the perforations and/ or the frangible sheet material portions are nonuniform.

In another aspect, above 20% of each of the zones of weakness comprises frangible sheet material portions narrower in width and greater in frequency than the frangible sheet material portions in the remainder of each of the zones of weakness.

In still another aspect, the collective center of the centers of gravity of the frangible sheet material portions on at least one side of the center line of the sheet material is substantially closer to a separation initiation region of the sheet material than to a separation control region of the sheet material.

In an additional aspect, the frangible sheet material portions in a separation initiation region of the sheet material are narrower and greater in frequency than the frangible sheet material portions in a separation control region of the sheet material, and the percent difference between the percent bond of the separation initiation region and the percent bond of the separation control region is less than about 20%.

In another aspect, the ratio of the perforation width in the separation initiation region to the perforation width in the separation control region is less than about 90%.

In another aspect, the ratio of the average energy absorption capacity per bond in the control region to the average energy absorption capacity per bond in the initiation region is at least about 4.

In a further aspect, the present invention includes a dispensing system including a dispenser having an outlet for allowing sheet material to be dispensed from the dispenser.

In yet another aspect, the present invention includes a dispensing system wherein the width of the outlet of the dispenser is less than the overall width of the sheet material.

In an even further aspect of the invention, a method is provided to control the exposed length (length of the tail) of sheet material extending from the outlet of the dispenser when a user dispenses sheet material from the sheet material dispensing system. This method includes controlling initiation of separation of adjacent sheet material segments by providing the sheet material with a predetermined width of at least one separation initiation region having frangible sheet material portions narrower in width and greater in frequency than the frangible sheet material portions in at least one separation control region of the sheet material. The method also includes controlling the time to complete separation of adjacent sheet material segments by providing the separation control region of the sheet material with frangible sheet material portions wider in width and lower in frequency than the frangible sheet material portions in the separation initiation region of the sheet material.

It is to be understood that both the foregoing general description and the following detailed description are exemplary, and are intended to provide further explanation of the invention as claimed.

BRIEF DESCRIPTION OF THE DRAWINGS

The accompanying drawings are included to provide a further understanding of the invention and are incorporated in and constitute a part of this specification. The drawings illustrate embodiments of the invention and, together with the description, serve to explain the principles of the invention. In the drawings.

DESCRIPTION OF THE PREFERRED EMBODIMENTS

Figure 1:
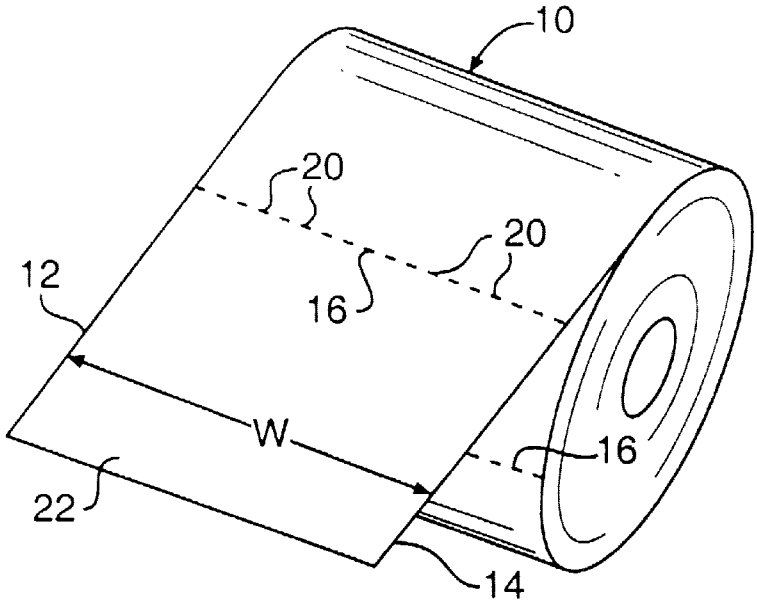
FIG. 1 is a perspective view of an embodiment of sheet material of the present invention.

Reference will now be made in detail to the present preferred embodiments of the invention, examples of which are illustrated in the accompanying drawings.

Wherever possible, the same reference numbers are used in the drawings and the description to refer to the same or like parts.

In accordance with the invention, there is provided sheet material for being dispensed from a dispenser. As shown in FIG. 1, sheet material 10 includes opposite edges 12 and 14 defining the overall width W of the sheet material 10. (As used herein, the length or dispensing direction of the sheet material 10 is parallel to the edges 12 and 14, and the width of the sheet material 10 or portions of the sheet material 10 is orthogonal to the edges 12 and 14.) The sheet material 10 is preferably absorbent paper toweling wound in a cylindrical shaped roll either with or without a core. Alternatively, the sheet material 10 may be in an accordion folded stack or any other form allowing for continuous feed.

The sheet material 10 may be formed in many different ways by many different processes. Sheet material can be classified as woven material or fabric, like most textiles, or a non-woven material. For example, the sheet material could be a non-woven fabric-like material composed of a conglomeration of fibrous materials and typically non-fibrous additives. Non-wovens may be classified further into wet-formed materials and dry-formed materials. As used herein, wet-formed materials are those materials formed from an aqueous or predominantly aqueous suspension of synthetic fibers or natural fibers, such as vegetable, mineral, animal, or combinations thereof by draining the suspension and drying the resulting mass of fibers; and dry-formed materials are those materials formed by other means such as air-laying, carding or spinbonding without first forming an aqueous suspension. Non-wovens may further include composites of wet and dry formed materials where the composite is formed by means such as hydroentangling or laminating.

The sheet material 10 includes a plurality of zones of weakness spaced along the length of the sheet material 10. Each zone of weakness includes a plurality of perforations and a plurality of frangible sheet material portions, also referred to herein as "bonds." As used herein, the term "perforations" includes scores, slits, voids, holes, and the like in the sheet material 10. Each zone of weakness includes single or multiple lines of perforations separating segments of the sheet material 10. The strength of each zone of weakness is equivalent to that of a perforated tear line having a total width of frangible sheet material portions of preferably from about 10% to about 30%, more preferably from about 14% to about 26%, and most preferably from about 18% to about 22%, of the overall width W of the sheet material 10. For purposes of explanation, each zone of weakness is described as a single line of perforations, but the invention is not so limited.

As shown in FIG. 1, the sheet material 10 includes a plurality of perforated tear lines 16 preferably spaced apart at even intervals along the length of the sheet material 10. When a user pulls an end portion 22 of the sheet material 10, a single material sheet having a length equal to the spacing between the tear lines 16 separates from the remainder of the sheet material 10 along the end most perforated tear line 16. The perforated tear lines 16 are preferably straight, parallel to each other, and orthogonal to the edges 12 and 14, and preferably extend across the entire sheet width W. Any other type of perforation tear line is also possible and is included within the scope of the invention. For example, the perforation tear lines could be non-evenly spaced along the length of the sheet material, curved, zig-zag shaped, non-orthogonal with respect to the edges of the sheet material, and/or shortened in the width direction.

Figure 2:
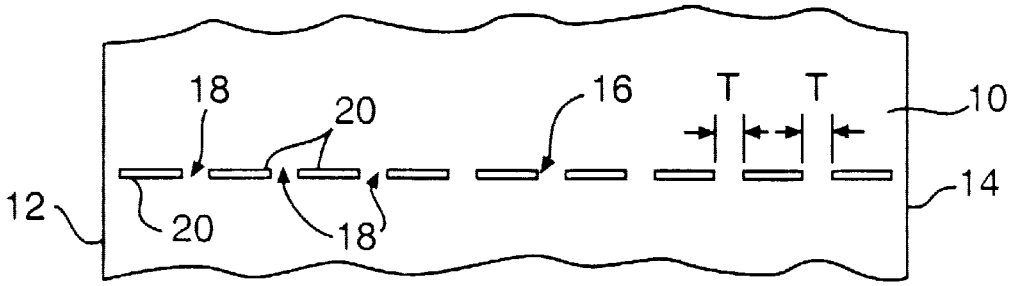
FIG. 2 is a plan view of a portion of the sheet material of FIG. 1 showing a perforated tear line between adjoining sheet material segments.

As shown in FIG. 2, each of the perforated tear lines 16 includes frangible sheet material portions (bonds) 18 and perforations 20 passing completely through the sheet material 10. In each of the perforated tear lines 16, at least a single perforation is preferably between each pair of adjacent frangible sheet material portions, and at least a single frangible sheet material portion 18 is preferably between each pair of adjacent perforations. Preferably, the perforations 20 are elongated, axially aligned, and slit shaped, however, other configurations of the perforations are possible.

Figure 8:
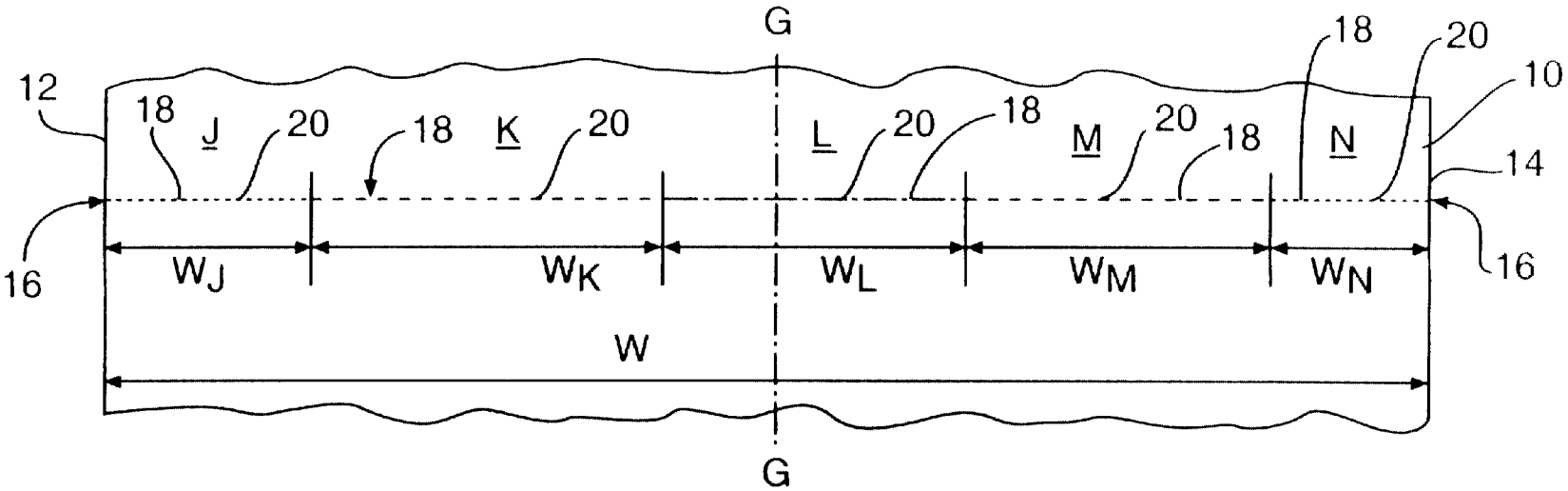
FIG. 8 is a plan view of a portion of an alternate embodiment of the sheet material having perforated tear lines with nonuniform frangible sheet material portions (bonds) and perforations.

In the embodiment shown in FIG. 2, the width and spacing of the frangible sheet material portions 18 are uniform, as are the width and spacing of the perforations 20, along the overall width W. However, alternative configurations are possible. For example, the frangible sheet material portions and/or the perforations between the portions could be nonuniform in width and/or spacing along part or all of the overall width W. FIG. 8 shows an alternative embodiment having perforated tear lines 16 with frangible sheet material portions 18 of nonuniform width and spacing and with perforations 20 of nonuniform width and spacing. Further details regarding the construction and the configuration of other types of perforated tear lines are disclosed in U.S. Pat. No. 5,704,566 to Schutz et al., and in U.S. patent application Ser. No. 08/942,771, filed on Oct. 2, 1997 abandoned, the entire disclosures of which are incorporated herein by reference.

The inventors have discovered that certain characteristics of the sheet material 10 are related to improving reliability of dispensing such that the user obtains a single, fully intact sheet which has separated cleanly and completely from the remaining sheet material along the perforated tear line and where a sufficient length, typically about 2 to about 4 inches, of the remaining end portion of sheet material extends from the outlet of the dispenser so as to be available for subsequent dispensing. These sheet material characteristics include the elasticity of the sheet material 10, the width of frangible portions 18 in the tear lines 16, the space between adjacent perforated tear lines, the width of the sheet material 10, the dry tensile strength of the sheet material 10, the tensile ratio of the sheet material 10, and particularly when the sheet material 10 is absorbent, the wet tensile strength of the sheet material 10.

Other characteristics of the sheet material 10 also improve dispensing. For example, the inventors have discovered that the width, spacing, frequency, and/ or positioning of the frangible sheet material portions 18 and/ or the perforations 20 affect reliability of sheet material dispensing. In addition, the inventors have discovered that the average energy absorption capacity of sheet material portions 18 (bonds), for example, also affects the reliability of dispensing.

For any given towel having a specified tensile strength, the perforation may be determined empirically so that when balanced against the drag forces exerted on the sheet material, reliable touch-less dispensing of single sheets will result. The most preferred values of the parameters disclosed in this application and in U.S. Pat. No. 6,321,963 constitute a particularly effective combination for facilitating reliable dispensing of single sheets.

Touch-less dispensing operates in the following manner. When a user pulls on the terminal end of the sheet material, the sheet material begins to move. When the pulling force exceeds the sum of the drag forces within the dispenser, the drag forces are adjusted such that they are lower than, or at most equal to, the tensile strength of the sheet material in the zone of weakness. Thus, when the zone of weakness passes downstream of a nip (restricted passageway) in the dispenser, the sheet material does not tear prior to encountering the edges of the restricted outlet of the dispenser. When the zone of weakness encounters the edges of the outlet, the drag forces are concentrated at the edges of the sheet material such that they exceed the tensile strength in the zone of weakness and initiate tearing of the perforation bonds. Continued pulling propagates the tear across the entire sheet. For a given tensile strength, the perforation bond width and percent bond can be calculated empirically so as to allow controlled propagation of the tear to result in the desired tail length of remaining sheet material extending from the dispenser outlet.

The sheet material 10 is preferably absorbent paper toweling having an overall length (in the dispensing direction) of about 250 feet or more and an overall width W of from about 4 inches to about 14 inches. The sheet material 10 has a dry tensile strength in the dispensing direction of preferably from about 4,000 grams per 3 inches of width to about 12,000 grams per 3 inches of width, more preferably from about 5,000 grams per 3 inches of width to about 10,000 grams per 3 inches of width, and most preferably from about 6,000 grams per 3 inches of width to about 8,000 grams per 3 inches of width, in the non-perforated area of the sheet material 10.

In accordance with the invention, the elasticity of the sheet material dispensing direction is preferably from about 4% to about 20%, more preferably from about 6% to about 16%, and most preferably about 8% to about 12%, in the non-perforated area of the sheet material 10. As used herein, the term "elasticity" means change in the length of the sheet material 10 under peak load (tensile force to break the sheet material at an area other than one of the perforated tear lines) expressed as a percentage of the length of the sheet material 10 under no load.

The perforated tear lines 16 of each pair of adjacent perforated tear lines 16 are preferably spaced apart along the length of the sheet material 10 by a distance of preferably from about 50% to about 200% of the overall width W of the sheet material 10, and more preferably from about 75% to about 125% of the overall width W.

In the embodiment shown in FIG. 2, each of the frangible sheet portions 18 has a width T (extending in a direction generally orthogonal to the edges 12 and 14) of preferably from about 0.3 mm to about 1.8 mm, more preferably from about 0.4 mm to about 1.3 mm, and most preferably from about 0.5 mm to about 1 mm. In each of the perforated tear lines 16, the total (combined) width of the frangible sheet portions 18 is preferably from about 10% to about 30% of the overall width W of the sheet material 10, more preferably from about 14% to about 26% of the overall width W, and most preferably from about 18% to about 22% of the overall width W.

As mentioned above, FIG. 8 shows an embodiment of the sheet material having nonuniform frangible sheet material portions 18 and/ or perforations 20. FIG. 8 illustrates a portion of sheet material 10 having a center line G—G, side edges 12 and 14 separated by width W, and a perforation tear line 1 composed of frangible sheet material bonds 18 and perforations 20 which pass through the sheet material 10. Perforation tear line 16 is preferably divided into discrete regions labeled Region J, Region K, Region L, Region M, and Region N. The width of each region is designated as $W_J$, $W_K$, $W_L$, $W_M$, and $W_N$, the sum of which is equal to the total sheet width W. The width of each of the Regions J–N could be the same or different, and the Regions J–N could be combined in any manner. Regions J–N could be symmetrically or asymmetrically oriented about the center line G—G of the sheet material 10.

Each of the Regions J–N of perforation tear line 16 is composed of frangible bonds 18 and perforations 20 of a specific width such that within each of the regions J–N, the initiation and/or propagation of sheet separation behaves substantially the same. The width P of an individual frangible bond within a particular region can be described as $P_i$ and the individual spacing width R between bonds (the width of the perforations) within the same region can be described as $R_i$. The average total percent bond of a particular region with n pairs of bonds and perforations can be described: $(1/n)\ \Sigma P_i/(P_i+R_i)$ for i=1 to n.

To separate a discrete end portion of sheet material from the remainder of sheet material, the frangible sheet material portions along the perforations tear line 16 must be broken. Bond breakage along the perforation tear line is composed of initiation of bond breakage and control of the bond breakage propagation until complete sheet separation is achieved. Initiation regions contain frangible sheet material portions (bonds) where initial perforation tear line breakage could occur. A perforation tear line may contain a single initiation region or multiple initiation regions, each capable of facilitating initiation of bond breakage when sufficient force is applied to the frangible bond(s) contained therein. A perforation tear line may contain a single or multiple control regions, each containing frangible bonds (frangible sheet material portions) that control the rate of bond breakage along the perforation tear line toward complete separation. Propagation of bond breakage will continue along the tear line as long as sufficient force and/or resistance is applied to the sheet material.

The initiation and control regions can be located in many different places along the width of the sheet material. In one embodiment, one or more of the initiation regions is located near at least one of the edges 12 and 14 of the sheet material and one or more of the control regions is located near the middle of the sheet material. In another embodiment, one or more of the initiation regions is located near the middle of the sheet material and one or more of the control regions is located near at least one of the edges 12 and 14 of the sheet material. Those skilled in the art could recognize that any combination of control and initiation regions is possible.

The strength in the initiation region(s) is preferably less than the strength within the control region(s). Preferably, the width of the frangible bonds in the initiation region(s) is less than the width of the frangible bonds within the control region(s). The frequency of the bonds (the number of bonds per unit length) is preferably greater in the initiation region (s) than in the control region(s).

Preferably, at least about 20% of each of the perforation tear lines 16 have bonds narrower and greater in frequency than bonds in the remainder of each of the perforation tear lines 16. Alternatively, above 20%, at least about 25%, at least about 30%, at least about 35%, at least about 40%, at least about 45%, at least about 50%, at least about 55%, at least about 60%, at least about 65%, at least about 70%, at least about 75%, or at least about 80% of each of the perforation tear lines have bonds narrower and greater in frequency than bonds in the remainder of each of the perforation tear lines.

The total percent bond of an initiation region may be similar to or different from that of a control region. The percent difference between the percent bond of the initiation region and the percent bond of the control region is preferably less than about 20%, and more preferably less than about 10%.

The width of the perforations in the initiation region can be different from or substantially the same as the width of the perforations in the control region. The ratio of the perforation width in the separation initiation regiorrto the perforation width in the separation control region is preferably less than about 90% and more preferably less than about 70%.

For example, when the sheet material 10 shown in FIG. 8 has perforation tear lines 16 with multiple initiation regions, Region J and Region N are initiation regions, and Regions K, L, and M are control regions. In another example, when the sheet material has perforation tear lines with multiple initiation regions, Region J, Region L and Region N are initiation regions, and Region K and Region M are control regions. In another example, when the sheet material has perforation tear lines with a single initiation region, Region L is an initiation region and Regions J, K, M, and N are control regions. In a further example, Region J is an initiation region and Regions K through N are control regions.

For material dispensing systems designed to dispense individual sheets from continuous webs of perforated sheet material through an outlet in the dispenser, the length of material left protruding from the outlet after each dispensing, commonly referred to as a "tail" , is a function of the time required to break all the bonds. The time is related to the rate at which the frangible sheet material portions (bonds) 18 break and the length of the line of perforations 16. The average length of the tail can be controlled by varying the width of the individual frangible sheet material portions 18, controlling the length of the line of perforations, or both. The rate of separation of sheets can be controlled while maintaining the same percent bond, i.e. maintaining the same ratio of the width of the frangible sheet material portions 18 to the width of the perforations 20 along the overall width W of each line of perforations 16. For example, when the width of the frangible sheet material portions 18 (and optionally the width of the perforations 20) is increased from the section or sections of the perforation line 16 where separation is initiated (initiation region) to the section or sections of the perforation line 16 where separation is controlled (control region), the overall rate of separation will be less than if the frangible sheet material portions 18 remained uniform in width from the initiation region to the control region, and the tail on average will be longer. This effect is due to a change in the amount of energy being absorbed by frangible sheet material portions between different regions even if there is very little or no difference in the percent bond between the initiation region and the control region.

The change in bond width can be continuous with each succeeding bond (and optionally also each succeeding perforation) being slightly greater (or smaller) than the previous one, or the change can be done in one or more steps, i.e. g, number of bonds at width $h_1$ followed by $g_2$ number of bonds at width $h_2$. The number of bonds in each step may or may not be equal, and the overall length of each step may or may not be equal.

The data in Table 1 below was compiled from an experimental test in which sheet material having an overall width of about 10 inches was dispensed from a dispenser of the type described herein. The sheet material for this test had a uniform percent bond for each of the lines of perforation. As used herein, the term "percent bond" for a particular section of the perforation tear line is calculated by taking the sum of the widths of each of the bonds in a particular section and dividing this sum by the total width of the section. The dispensing method used for the test alternated between using one hand and using both hands every ten dispenses.

In Table 1, the column entitled "Short Tails (% of dispenses)" shows the percentage of sheet material dispenses that resulted in an insufficient (short) tail length. As shown in Table 1, short tails were reduced when the bond width in the control region was greater than the bond width in the initiation region, as compared to when the bond width was uniform. In this example, an initiation region was at each edge of the sheet material, the control region was at the middle of the sheet material between the initiation regions, the width of the two initiation regions was approximately equal, the control region was approximately equal in width to the sum of the width of the two initiation regions, and the bond width in each initiation region was the same. In the test, sheet separation was initiated at the edges of the sheet material and propagated towards the center. However, the same effect could be shown for the case where separation is initiated at the center and propagates toward the edges or for any other configurations of initiation regions and control regions.

TABLE 1

| Percent Bond (%) | | Bond Width (mm) | | |
|---|---|---|---|---|
| Initiation Region | Control Region | Initiation Region | Control Region | Short Tails (% of dispenses) |
| 18 | 18 | 0.5 | 0.5 | 8 |
| 18 | 18 | 0.5 | 0.8 | 1 |
| 18 | 18 | 0.5 | 1.0 | 2 |

The data in Table 1 is for a given dispenser design and a specific material having specific strength, stretch and energy absorption characteristics. Thus, the preferred bond width would have a value within a defined range depending on the design of the dispenser and material to be dispensed. It could also be shown that for certain combinations of dispenser and material design, it may be desired to reduce tail length by increasing the rate of separation which could be accomplished by reducing the difference in bond width between the initiation region and the control region. In either case, the preferred range, expressed as a ratio of the larger bond width to the smaller bond width, is from about 1.25 to about 3.00.

For every sheet material and sheet material dispenser, there is a preferred uniform perforation design that results in reliable dispensing. This preferred design is a function of overall strength and stretch of the sheet material. The strength and stretch are directly influenced by a number of factors including the number of fibers per unit area (basis weight), the length of fibers, and the bonding strength between the fibers. The sheet material used in the test to produce the data shown in Table 1 had a basis weight of about 28 lb/ream and had fiber to fiber bonding strengths typical of low levels of refining. The percent bond for this example was 18%. Stronger sheets made from highly refined fibers and/or higher basis weights can easily have good separation performance along the perforation line with a percent bond below 18%. Conversely, lower weight and/or weaker sheets typically have better separation performance along the perforation line with a percent bond above 18%.

Bond width can not increase without limit because a point would be reached where propagation would be stopped altogether. The difference between the bond width of the control region and the bond width of the initiation region is influenced by the length of the individual sheet material segments (distance between lines of perforations) in that too long a tail will likely cause a short tail on the next dispense. Longer sheet material segments allow for a greater range of design alternatives to control the rate propagation of the tear. Bond width is related to the width of the control region. The width of the control region can be selected to allow a wider bond if desired. A narrower control region allows the use of wider bonds to manage the rate of separation as desired.

Fiber length also directly affects the preferred bond width. A longer average fiber length allows the bond width to be reduced at the same overall performance. The inventors have observed that preferred bond width decreased by ⅔ when the arithmetic average fiber length increased by a factor of two. This is thought to be primarily due to the increase in the number of active fibers in the bond. In this manner, controlling the rate of propagation of the tear can be influenced both by a change to the basis weight and a change to the bonding strength.

If tail length were the only concern in dispensing sheet material from dispensers of this type, changes to the length of the tail could be also be accomplished by changing the tension provided by the restraining means within the dispenser, including the geometry of the outlet, or by changing the overall percent bond. However, reliable dispensing is also judged by the frequency of obtaining a single, whole sheet of material. The preferred system design is one which provides the fewest occurrences of multiple sheet dispensing, tabbing, and short tails. In the above example, increasing the overall percent bond or reducing the tensioning force to produce longer tails would also result in increasing the frequency of multiple sheet dispensing whereas the change in bond widths alone did not. Similarly, increasing bond widths uniformly along the entire perforation line even at the same percent bond would also result in increased frequency of multiple sheet dispensing. In other words, there must be sufficient tensioning force and/or the bonds must be appropriate in both width and percent bond to initiate and propagate sheet separation over a range of dispensing habits.

In another embodiment, initiation of bond breakage along the perforation line can be improved by reducing the percent bond and bond width in the initiation region as compared to the control region. Table 2 below shows data from a test similar to that of the test that produced the data for Table 1. As shown in Table 2, the preferred bond width for the control region is greater than that for the example shown in Table. 1, this is due to the initial rate of propagation being greater in the example of Table 2 as compared to that of the example of Table 1 due to the relative ease with which sheet separation was initiated.

TABLE 2

| Percent Bond (%) | | Bond Width (mm) | | |
|---|---|---|---|---|
| Initiation Region | Control Region | Initiation Region | Control Region | Short Tails (% of dispenses) |
| 16 | 18 | 0.5 | 0.5 | 10 |
| 16 | 18 | 0.5 | 0.8 | 5 |
| 16 | 18 | 0.5 | 1.0 | 3 |

The spacing between the bonds (width of the perforations) directly influences the force transition from bond to bond during sheet separation. The instantaneous application of an applied load significantly increases the static load (up to twice).

Narrower perforation widths reduce the impact effect for a given bond width and Ieffectively reduce the rate of sheet separation.

While it can be thought of in terms of bond widths and certainly easier to measure bond widths, fundamentally, it is change in the amount of energy being absorbed by each of the frangible bonds in combination with the spacing between the bonds that controls the rate of sheet separation. The inventors have discovered that the ratio of the average energy absorption capacity per bond in the control region to the average energy absorption capacity per bond in the initiation region affects the rate of separation of individual sheets. Preferably, this ratio is at least about 4. A preferred range for this ratio is from about 4 to about 40, more preferably from about 4 to about 30, even more preferably from about 4 to about 20 and still more preferably from about 4 to about 10.

The inventors have found that the ratio of the energy absorption capacity of the individual bonds can be calculated by combining the number of active fibers in a bond with the arithmetic average fiber length and the bond width raised to the third power. The number and length of the fibers in the bond directly influence the number of fiber-to-fiber bonds which must be broken in order to break that particular bond. The bond width raised to the third power reflects the understanding that when shear is accompanied by bending, as with the progressive transfer of forces in the process of tearing a sheet along a perforation line, the unit shear increases from the extreme fiber to the neutral axis. In addition, the maximum shear force is inversely proportional to the bond width raised to the third power. Since the ratio is of interest, the calculations only included those factors which were not constant. As such, the calculation for the energy absorption capacity for a single bond was a multiplication of the bond width raised to the third power with both the arithmetic average fiber length and the number of active fibers in the bond. The number of active fibers in the bond were calculated by multiplying the bond width by both the weight weighted average fiber length and a constant having the value of 15.

The following table shows how an estimate of the number of active fibers in a particular region (the calculated number of fibers) is determined according to the formula: Bond Width×Weight Weighted Average Fiber Length×15=Calculated Numbers of Fibers.

TABLE 3

| Example | Bond Width (mm) | Weight Weighted Average Fiber Length (mm) | Calculated No. of Fiber | Measured Active Fiber |
|---|---|---|---|---|
| 5 | 0.5 | 3.08 | 23.0 | 27.0 |
| 6 | 0.8 | 3.08 | 36.9 | 37.8 |
| 7 | 1.2 | 3.08 | 55.3 | |
| 8 | 0.8 | 2.02 | 24.2 | 22.8 |
| 9 | 1.2 | 2.02 | 36.3 | 30.6 |

The following table shows how the energy absorption capacity of a single bond is calculated according to the formula: Bond Width$^3$×Arithmetic Average Fiber Length×No. Active Fiber=Energy Absorption Capacity.

TABLE 4

| Example | Bond Width (mm) | Arithmetic Average Fiber Length (mm) | Bond Width$^3$ | No. Active Fiber | Calculated Energy Absorption Capacity |
|---|---|---|---|---|---|
| 5 | 0.5 | 1.06 | 0.125 | 27 | 3.6 |
| 6 | 0.8 | 1.06 | 0.512 | 37.8 | 20.5 |
| 7 | 1.2 | 1.06 | 1.728 | 55.3 | 101.3 |
| 8 | 0.8 | 0.4 | 0.512 | 22.8 | 4.7 |
| 9 | 1.2 | 0.4 | 1.728 | 31 | 21.4 |

In the two preceding tables, Examples 5 and 6 show data for the same sheet material used to provide the data for the second row of Table 1, where the initiation region has a bond width of 0.5 mm and the control region has a bond width of 0.8 mm.

The inventors have also discovered that the location of the centers of gravity of the frangible sheet material portions (bonds) affect dispensing reliability. In particular, the inventors have discovered that the position of the collective center of the centers of gravity of the bonds affects the reliability of dispensing. The collective center of the centers of gravity of a plurality of bonds is calculated by determining the location of the centers of gravity for each of the individual bonds, calculating a common center of gravity for two of the bonds, and then by considering these two bonds as a single bond with the weight concentrated at the common center of gravity, the center of gravity with reference to a third bond is located. This process is continued until all the bonds in a section of the sheet material have been considered. The resulting center of gravity location is the location of the collective center of the centers of gravity for each of the bonds in that section.

In the present invention, the collective center of the centers of gravity of the bonds on at least one side of the center line of the sheet material is substantially closer to the separation initiation region of the sheet material than to the separation control region. The collective center on the other side of the center line can be the same or different. In a further embodiment, the collective center of the centers of gravity of the bonds on at least one side of the center line is substantially closer to an edge of the sheet material than to the center line of the sheet material. The collective center on the other side of the center line can be the same or different. In a further embodiment, the collective center of the centers of gravity of the bonds on only one side of the center line is substantially closer to the center line of the sheet material than to one of the edges of the sheet material. The collective center on the other side of the center line can be different.

The present inventors have found that tabbing in dispensing of absorbent materials, such as paper towels, with one or more wet hands is most strongly correlated to the lowest wet tensile strength in the plane of the web. Testing was conducted to determine the preferred wet tensile strength for the sheet material 10 when the sheet material 10 is an absorbent material, such as paper toweling, having a wet strength less than its dry strength. Wet tensile strength is measured in the "weakest direction" of the material, which is normally the direction orthogonal to the dispensing direction. As used herein, the "weakest direction" of the sheet material 10 is the direction of the sheet material 10 in the plane of the web having the lowest strength.

In accordance with the invention, the sheet material 10 has a wet tensile strength in the weakest direction, typically a direction orthogonal to the dispensing direction, of preferably at least about 900 grams per 3 inches of width, more preferably at least about 1050 grams per 3 inches of width, and most preferably at least about 1175 grams per 3 inches of width, in the non-perforated area of the sheet material 10.

The sheet material 10 preferably has a tensile ratio of less than about 2, more preferably less than about 1.8, and most preferably less than about 1.6 in the non-perforated area of the sheet material 10. As used herein, the term "tensile ratio" is a ratio equivalent to the dry tensile strength in the machine direction divided by the dry tensile strength in the cross machine direction.

In one preferred embodiment, the sheet material 10 is wet-formed having a total width of the frangible sheet material portions 18 in each perforated tear line 16 of from about 10% to about 30% of the overall width W of the sheet material 10, an elasticity in the dispensing direction of from about 4% to about 20%, a dry tensile strength in the dispensing direction of from about 4,000 grams per 3 inches of width to about 12,000 grams per 3 inches of width, and a wet tensile strength in a direction orthogonal to the dispensing direction of at least about 900 grams per 3 inches of width.

In another preferred embodiment, the sheet material 10 is dry-formed having a total width of the frangible sheet material portions 18 in each perforated tear line 16 of from about 10% to about 30% of the overall width W of the sheet material 10, an elasticity in a dispensing direction of from about 4% to about 20%, and a dry tensile strength in the dispensing direction of from about 4,000 grams per 3 inches of width to about 12,000 grams per 3 inches of width.

Figure 3:
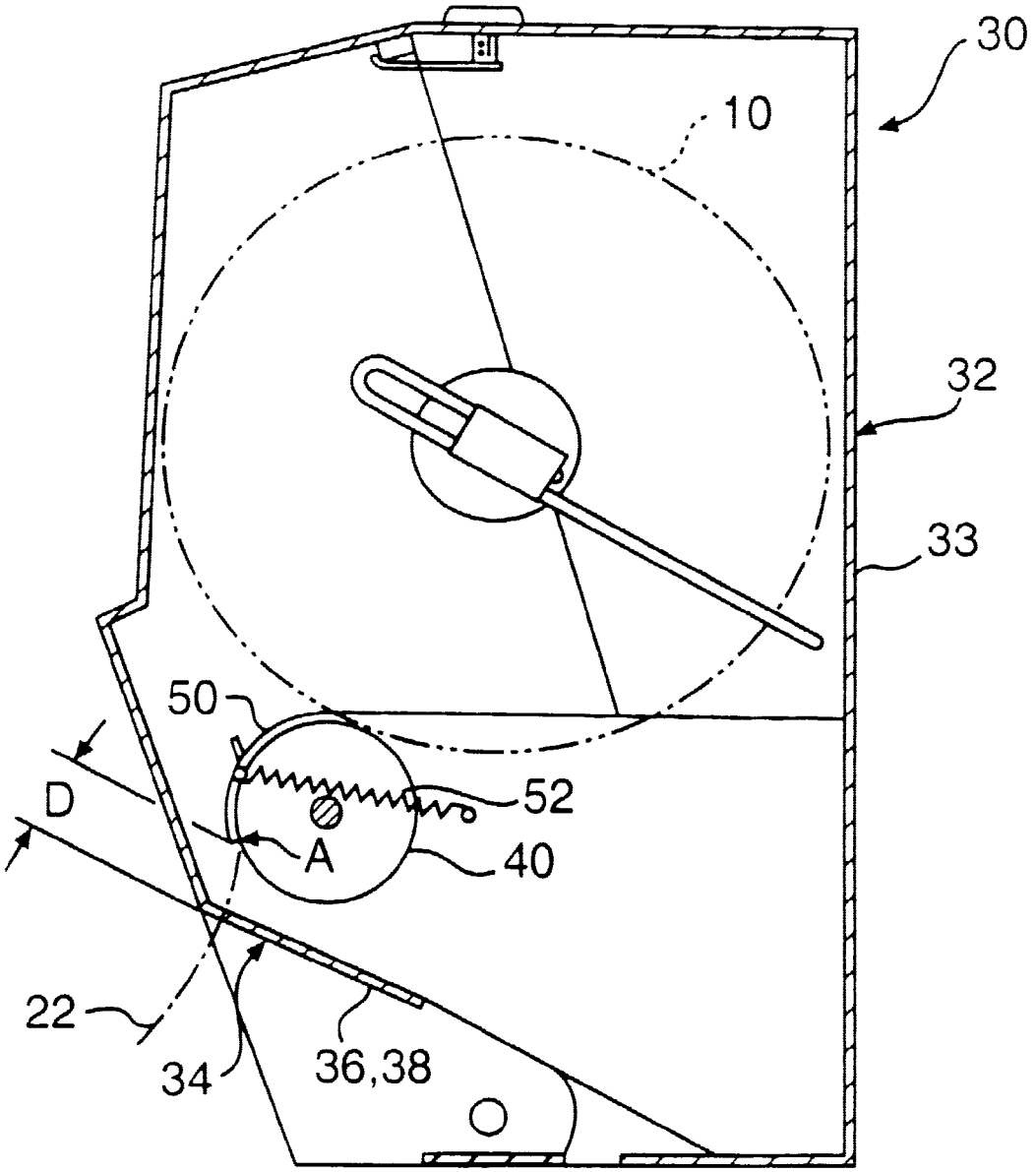
FIG. 3 is a partially schematic cross-sectional view of a sheet material dispensing system including a sheet material dispenser and the sheet material of FIG. 1 in the interior of the sheet material dispenser.
Figure 4:
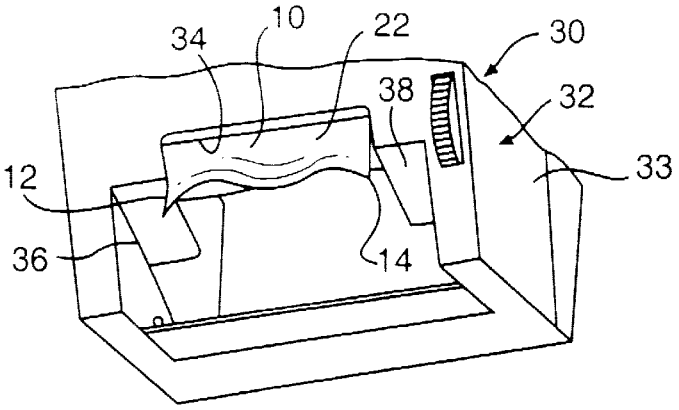
FIG. 4 is a perspective view of a portion of the sheet material dispenser of FIG. 3 and an end segment of the sheet material extending from an outlet of the dispenser.
Figure 5:
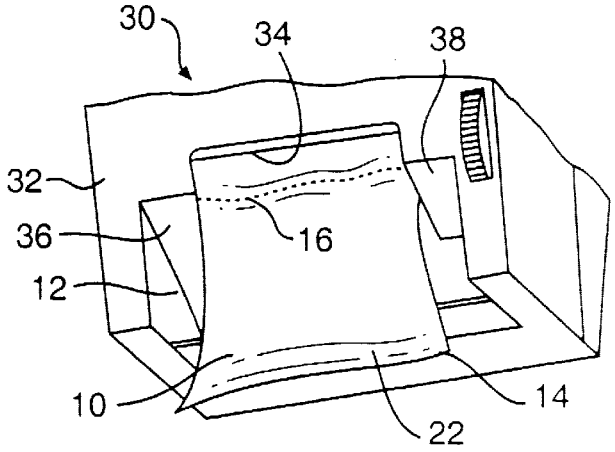
FIG. 5 is a view similar to FIG. 4 showing the end segment of sheet material being pulled from the outlet of the dispenser.
Figure 6:
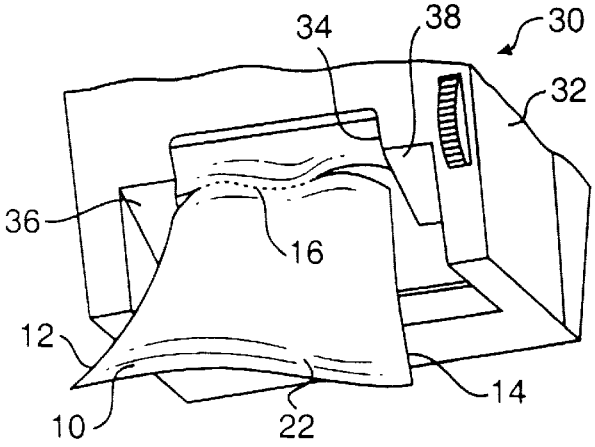
FIG. 6 is a view similar to FIG. 4 showing initiation of separation of the end segment of sheet material along a perforated tear line.

FIGS. 3 and 4 show a sheet material dispensing system 30 in accordance with the present invention. The sheet material dispensing system 30 includes a dispenser 32 having a housing 33 defining an interior for containing the sheet material 10 and an outlet 34 shown in FIG. 4 for allowing passage of the sheet material end portion 22 from the interior of the dispenser 32. According to the dispensing system of the present invention, the outlet 34 can have a width of any size. In a preferred embodiment, as shown in FIG. 4, dispenser wall surfaces 36 and 38 define a portion of the outlet 34 and are spaced apart so that the outlet 34 preferably has a width less than the overall width W of the sheet material 10. This width difference causes the edges 12 and 14 of the sheet material 10 to encounter drag as sheet material 10 is dispensed through the outlet 34, as shown in FIGS. 4–6. Working in combination with other tensioning forces induced in the sheet upstream from the outlet, this drag produces the final, critical component of force required to overcome the tensile strength of the frangible sheet material portions 18 in the perforated tear line 16 and initiates separation of the sheet being pulled from the remainder of the sheet material.

The dispenser 32 could be any type of dispenser for sheet material. For example, the dispenser 32 could be constructed like the dispensing apparatus disclosed in above-mentioned U.S. Pat. No. 5,630,526 to Moody and in above-mentioned U.S. Pat. No. 5,868,275. In a preferred embodiment, the dispenser 32 is constructed like the dispensing apparatus disclosed in above-mentioned U.S. Pat. No. 6,321,963, the entire disclosure of which is incorporated herein by reference.

Figure 7:
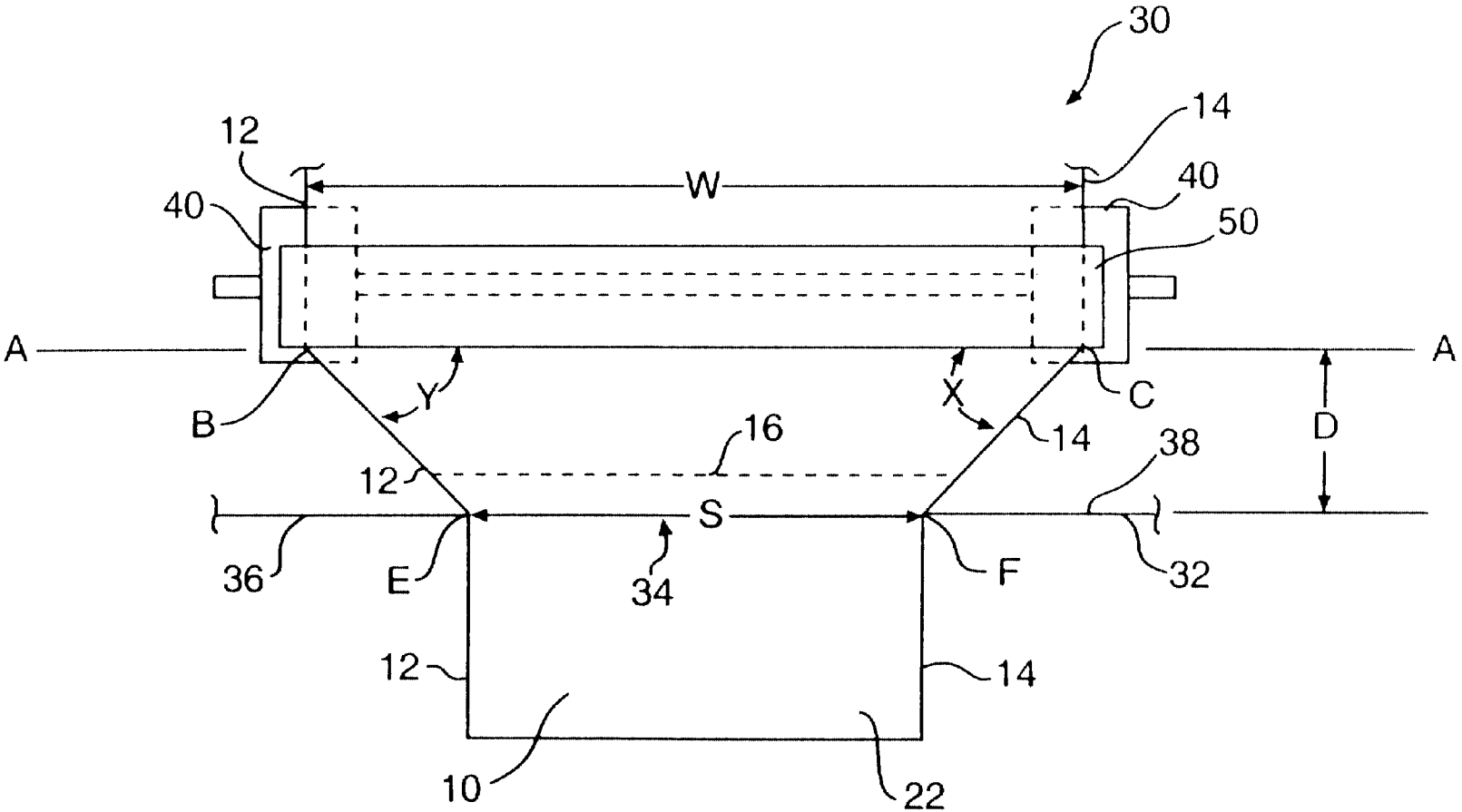
FIG. 7 is a schematic front view of the sheet material in the interior of the dispenser of FIG. 3.

As shown in FIGS. 3 and 7, the interior of the dispenser 32 preferably includes one or more rollers 40. For example, the dispenser 32 may include a single one of the rollers 40 extending along the width of the dispenser 32. The roll of sheet material 10 is mounted in the interior of the dispenser 32 so that the outer surface of the roll contacts the outer surface of the rollers 40. The dispenser 32 preferably includes at least two surfaces forming a nip (restricted passageway) through which the sheet material 10 passes during dispensing. Preferably, the dispenser 32 includes a nipping element 50 having an inner surface forming the nip with an outer surface of one or more of the rollers 40. The nipping element 50 is preferably a plate movably mounted in the housing 33, and at least one spring 52 biases the nipping element 50 toward the outer surface of the rollers 40 to form the nip. Although the nip is preferably formed between the nipping element 50 and the rollers 40, the nip could be formed between other surfaces in the dispenser 32. For example, the nip could be formed between the rollers 40 and one or more additional rollers (not shown) mating with the rollers 40 or the nip could be formed between a surface of the housing 33 and the rollers 40.

The inventors have discovered that certain characteristics of both the sheet material 10 and the dispenser 32 improve the reliability of dispensing and/ or separation of individual material sheets. These characteristics include the relationship between the width S (see FIG. 7) of the outlet 34, the overall sheet material 10 width W, a distance D, described below, and angles X and Y, described below.

As shown schematically in FIG. 7, an imaginary line A is defined as a line extending along the exit of the nip (the downstream end of the nip in the direction of travel of the sheet material). Points E and F are points of contact between sheet material dispensed through outlet 34 and the edges of the wall surfaces 36 and 38 defining the outlet 34. Points E and F are preferably spaced a distance D of from about 0.1 inch to about 3 inches, more preferably from about 0.8 inches to about 1.1 inches, most preferably from about 0.9 inch to about 1 inch, to the respective closest point on line A. Points B and C are defined by the outermost (in the width direction) lateral end of the nip that contains the sheet material along line A. Angles X and Y are defined as angles formed between line A and the lines connecting points C and F and points B and E, respectively.

These values are related by the following equations:

$$\text{Arc Tangent}\left(\frac{D}{1/2(w-s)}\right) = X(\text{Radians})$$

$$X(\text{Radians}) \times \frac{180°}{\pi} = X°$$

This assumes that S and W have the same center point (they are symmetrical with respect to the outlet 34, and X=Y). For an asymmetrical orientation, the value of "½ (W-S)" can be found by direct measurement.

In accordance with the invention, the width S of the outlet 34 is preferably from about 20% to about 90% of the sheet material width W, more preferably from about 55% to about 85% of the sheet material width W, even more preferably from about 65% to about 75% of the sheet material width W, and most preferably about 70% of the sheet material width W. In addition, the angles X and Y are preferably from about 26° to about 39°, more preferably from about 29° to about 36°, and most preferably from about 32° to about 33°.

The following are examples of sheet material successfully dispensed from a dispenser constructed according to the invention having an outlet width S of about 7 inches, a distance D of about 0.95 inch, and angles X and Y equal to about 32.5°.

EXAMPLE A

Bleached T.A.D. (through air dryed) sheet material having a basis weight of about 28.5 lb/ream, MD (machine direction) dry tensile strength of about 6994 grams per 3 inches of width, a CD (cross-machine direction) wet tensile strength of about 1281 grams per 3 inches of width, an MD elasticity of about 10.3%, a tensile ratio of about 1.50, a width of about 0.5 mm for each frangible sheet material portion, and a total width of frangible sheet material portions in each perforated tear line of about 18% of the overall width of the sheet material.

EXAMPLE B

Bleached T.A.D. sheet material having a basis weight of about 27.9 lb/ream, MD dry tensile strength of about 6119 grams per 3 inches of width, a CD wet tensile strength of about 1186 grams per 3 inches of width, an MD elasticity of about 6.6%, a tensile ratio of about 1.43, a width of about 0.5 mm for each frangible sheet material portion, and a total width of frangible sheet material portions in each perforated tear line of about 18% of the overall width of the sheet material.

EXAMPLE C

Unbleached wet crepe sheet material having a basis weight of about 27.7 lb/ream, MD dry tensile strength of about 6388 grams per 3 inches of width, a CD wet tensile strength of about 1180 grams per 3 inches of width, an MD elasticity of about 8.6%, a tensile ratio of about 1.85, a width of about 1.0 mm for each frangible sheet material portion, and a total width of frangible sheet material portions in each perforated tear line of about 22% of the overall width of the sheet material.

EXAMPLE D

Unbleached wet crepe sheet material having a basis weight of about 27.0 lb/ream, MD dry tensile strength of about 5885 grams per 3 inches of width, a CD wet tensile strength of about 1396 grams per 3 inches of width, an MD elasticity of about 7.0%, a tensile ratio of about 1.33, a width of about 0.8 mm for each frangible sheet material portion, and a total width of frangible sheet material portions in each perforated tear line of about 22% of the overall width of the sheet material.

In accordance with the invention, a method is provided to control the exposed length (length of the tail) of sheet material extending from the outlet of the dispenser when a user dispenses sheet material from the sheet material dispensing system. This method includes controlling initiation of separation of adjacent sheet material segments by providing the sheet material with a predetermined width of at least one separation initiation region having frangible sheet material portions narrower in width and greater in frequency than the frangible sheet material portions in at least one separation control region of the sheet material. The method also includes controlling the time to complete separation of adjacent sheet material segments by providing the separation control region of the sheet material with frangible sheet material portions wider in width and lower in frequency than the frangible sheet material portions in the separation initiation region of the sheet material.

It will be apparent to those skilled in the art that various modifications and variations can be made to the structure and methodology of the present invention without departing from the scope or spirit of the invention. In view of the foregoing, it is intended that the present invention cover modifications and variations of this invention provided they fall within the scope of the following claims and their equivalents.

What is claimed is:

1. Dispensable sheet material having opposite side edges spaced apart from one another to define the overall width of the sheet material, the sheet material comprising:

a plurality of zones of weakness spaced along the sheet material, the zones of weakness comprising a plurality of perforations and frangible sheet material portions, wherein above 20% of each of the zones of weakness comprises frangible sheet material portions narrower and greater in frequency than the frangible sheet material portions in the remainder of each of the zones of weakness, and wherein the percent difference between the percent bond of a separation initiation region of the sheet material and the percent bond of a separation control region of the sheet material is less than about 10%.

2. The sheet material of claim 1, wherein at least about 25% of each of the zones of weakness comprises frangible sheet material portions narrower and greater in frequency than the frangible sheet material portions in the remainder of each of the zones of weakness.

3. Dispensable sheet material having opposite side edges spaced apart from one another to define the overall width of the sheet material, the sheet material comprising:

a plurality of zones of weakness spaced along the sheet material, the zones of weakness comprising a plurality of perforations and frangible sheet material portions, wherein the percent difference between the percent bond of a separation initiation region of the sheet material and the percent bond of a separation control region of the sheet material is less than about 20%, and wherein at least about 30% of each of the zones of weakness comprises frangible sheet material portions narrower and greater in frequency than the frangible sheet material portions in the remainder of each of the zones of weakness.

4. The sheet material of claim 3, wherein at least about 35% of each of the zones of weakness comprises frangible sheet material portions narrower and greater in frequency than the frangible sheet material portions in the remainder of each of the zones of weakness.

5. The sheet material of claim 3, wherein at least about 40% of each of the zones of weakness comprises frangible sheet material portions narrower and greater in frequency than the frangible sheet material portions in the remainder of each of the zones of weakness.

6. The sheet material of claim 3, wherein at least about 45% of each of the zones of weakness comprises frangible sheet material portions narrower and greater in frequency than the frangible sheet material portions in the remainder of each of the zones of weakness.

7. The sheet material of claim 3, wherein at least about 50% of each of the zones of weakness comprises frangible sheet material portions narrower and greater in frequency than the frangible sheet material portions in the remainder of each of the zones of weakness.

8. The sheet material of claim 3, wherein at least about 55% of each of the zones of weakness comprises frangible sheet material portions narrower and greater in frequency than the frangible sheet material portions in the remainder of each of the zones of weakness.

9. The sheet material of claim 3, wherein at least about 60% of each of the zones of weakness comprises frangible sheet material portions narrower and greater in frequency than the frangible sheet material portions in the remainder of each of the zones of weakness.

10. The sheet material of claim 3, wherein at least about 65% of each of the zones of weakness comprises frangible sheet material portions narrower and greater in frequency than the frangible sheet material portions in the remainder of each of the zones of weakness.

11. The sheet material of claim 3, wherein at least about 70% of each of the zones of weakness comprises frangible sheet material portions narrower and greater in frequency than the frangible sheet material portions in the remainder of each of the zones of weakness.

12. The sheet material of claim 3, wherein at least about 75% of each of the zones of weakness comprises frangible sheet material portions narrower and greater in frequency than the frangible sheet material portions in the remainder of each of the zones of weakness.

13. The sheet material of claim 3, wherein at least about 80% of each of the zones of weakness comprises frangible sheet material portions narrower and greater in frequency than the frangible sheet material portions in the remainder of each of the zones of weakness.

14. Dispensable sheet material having opposite side edges spaced apart from one another to define the overall width of the sheet material, the sheet material comprising:

a plurality of zones of weakness spaced along the sheet material, the zones of weakness comprising a plurality of perforations and frangible sheet material portions, wherein the collective center of the centers of gravity of the frangible sheet material portions on at least one side of the center line of the sheet material is substantially closer to a separation initiation region of the sheet material than to a separation control region of the sheet material, and wherein the percent difference between the percent bond of the separation initiation region and the percent bond of the separation control region is less than about 10%.

15. The sheet material of claim 14, wherein the separation initiation region is near at least one of the edgeses of the sheet material.

16. Dispensable sheet material having opposite side edgeses spaced apart from one another to define the overall width of the sheet material, the sheet material comprising:

a plurality of zones of weakness spaced along the sheet material, the zones of weakness comprising a plurality of perforations and frangible sheet material portions, wherein the frangible sheet material portions in a separation initiation region the sheet material are narrower and greater in frequency than the frangible sheet material portions in a separation control region of the sheet material, and wherein the percent difference between the percent bond of the separation initiation region and the percent bond of the separation control region is less than about 10%.

17. The sheet material of claim 16, wherein the separation initiation region is near at least one of the edgeses of the sheet material.

18. The sheet material of claim 16, wherein the separation control region is near the middle of the sheet material.

19. Dispensable sheet material having opposite side edgeses spaced apart from one another to define the overall width of the sheet material, the sheet material comprising:

a plurality of zones of weakness spaced along the sheet material, the zones of weakness comprising a plurality of perforations and frangible sheet material portions, wherein the frangible sheet material portions in a separation initiation region of the sheet material are narrower and greater in frequency than the frangible sheet material portions in a separation control region of the sheet material, wherein the percent difference between the percent bond of the separation initiation region and the percent bond of the separation control region is less than about 20%, and wherein the separation control region is near at least one of the edges of the sheet material.

20. Dispensable sheet material having opposite side edgeses spaced apart from one another to define the overall width of the sheet material, the sheet material comprising:

a plurality of zones of weakness spaced along the sheet material, the zones of weakness comprising a plurality of perforations and frangible sheet material portions, wherein the frangible sheet material portions in a separation initiation region of the sheet material are narrower and greater in frequency than the frangible sheet material portions in a separation control region of the sheet material, and wherein the ratio of the perforation width in the separation initiation region to the perforation width in the separation control region is less than about 90%.

21. The sheet material of claims 20, wherein the ratio of the perforation width in the separation initiation region to the perforation width in the separation control region is less than about 70%.

22. The sheet material of claim 20, wherein the separation control region is near at least one of the edgeses of the sheet material.

23. The sheet material of claim 20, wherein the separation initiation region is near at least one of the edgeses of the sheet material.

24. The sheet material of claim 20, wherein the separation control region is near the middle of the sheet material.

25. The sheet material of claim 20, wherein the percent difference between the percent bond of the separation initiation region and the percent bond of the separation control region is less than about 20%.

26. The sheet material of claim 25, wherein the percent difference is less than about 10%.

27. A sheet material dispensing system comprising:

a dispenser defining an interior and an outlet for allowing sheet material to be dispensed from the interior of the dispenser; and the sheet material of claim 20, wherein the sheet material is in the interior of the dispenser.

28. The system of claim 27, wherein the width of the outlet is less than the overall width of the sheet material.

29. The system of claim 28, wherein the dispenser defines a nip, and wherein the sheet material passes through the nip.

30. The system of claim 27, wherein the dispenser defines a nip, and wherein the sheet material passes through the nip.

31. Dispensable sheet material having opposite side edgeses spaced apart from one other to define the overall width of the sheet material, the sheet material comprising:

a plurality of zones of weakness spaced along the sheet material, the zones of weakness comprising a plurality of perforations and frangible sheet material portions, wherein the frangible sheet material portions in a separation initiation region of the sheet material are narrower and greater in frequency than the frangible sheet material portions in a separation control region of the sheet material, and wherein the ratio of the average energy absorption capacity per bond in the control region to the average energy absorption capacity per bond in the initiation region is at least about 4.

32. The sheet material of claim 31, wherein the ratio of the average energy absorption capacity per bond in the control region to the average energy absorption capacity per bond in the initiation region is from about 4 to about 40.

33. The sheet material of claim 31, wherein the ratio of the average energy absorption capacity per bond in the control region to the average energy absorption capacity per bond in the initiation region is from about 4 to about 30.

34. The sheet material of claim 31, wherein the ratio of the average energy absorption capacity per bond in the control region to the average energy absorption capacity per bond in the initiation region is from about 4 to about 20.

35. The sheet material of claim 31, wherein the ratio of the average energy absorption capacity per bond in the control region to the average energy absorption capacity per bond in the initiation region is from about 4 to about 10.

36. The sheet material of claim 31, wherein the separation control region is near at least one of the edgeses of the sheet material.

37. The sheet material of claim 31, wherein the separation initiation region is near at least one of the edgeses of the sheet material.

38. The sheet material of claim 31, wherein the separation control region is near the middle of the sheet material.

39. The sheet material of claim 31, wherein the width of each of a plurality of perforations in the separation initiation region differs from the width of each of a plurality of perforations in the separation control region.

40. The sheet material of claim 31, wherein the percent difference between the percent bond of the separation initiation region and the percent bond of the separation control region is less than about 20%.

41. The sheet material of claim 40, wherein the percent difference is less than about 10%.

42. A sheet material dispensing system comprising:

a dispenser defining an interior and an outlet for allowing sheet material to be dispensed from the interior of the dispenser; and the sheet material of claim 31, wherein the sheet material is in the interior of the dispenser.

43. The system of claim 42, wherein the width of the outlet is less than the overall width of the sheet material.

44. The system of claim 43, wherein the dispenser defines a nip, and wherein the sheet material passes through the nip.

45. The system of claim 42, wherein the dispenser defines a nip, and wherein the sheet material passes through the nip.

46. Dispensable sheet material having opposite side edgeses space apart from one another to define the overall width of the sheet material, the sheet material comprising:

a plurality of zones of weakness spaced along the sheet material, the zones of weakness comprising a plurality of perforations and frangible sheet material portions, wherein above 20% of each of the zones of weakness comprises frangible sheet material portions narrower and greater in frequency than the frangible sheet material portions in the remainder of each of the zones of weakness, wherein the percent difference between the percent bond of a separation initiation region of the sheet material and the percent bond of a separation control region of the sheet matinee is less than about 20%, and wherein the width of each of a plurality of perforations in the separation initiation region differs from the width of each of a plurality of perforations in the separation control region.

47. Dispensable sheet material having opposite side edgeses spaced apart from one another to define the overall width of the sheet material, the sheet material comprising:

a plurality of zones of weakness spaced along the sheet material, the zones of weakness comprising a plurality of perforations and frangible sheet material portions, wherein the collective center of the centers of gravity of the frangible sheet material portions on at least one side of the center line of the sheet material is substantially closer to a separation initiation region of the sheet material than to a separation control region of the sheet material, wherein the percent difference between the percent bond of the separation initiation region and the percent bond of the separation control region is less than about 20%, and wherein the width of each of a plurality of perforations in the separation initiation region differs from the width of each of a plurality of perforations in the separation control region.

48. Dispensable sheet material having opposite side edgeses spaced apart from one another to define the overall width of the sheet material, the sheet material comprising:

a plurality of zones of weakness spaced along the sheet material, the zones of weakness comprising a plurality of perforations and frangible sheet material portions, wherein the frangible sheet material portions in a separation initiation region of the sheet material are narrower and greater in frequency than the frangible sheet material portions in a separation control region of the sheet material, wherein the percent difference between the percent bond of the separation initiation region and the percent bond of the separation control region is less than about 20%, and wherein the width of each of a plurality of perforations in the separation initiation region differs from the width of each of a plurality of perforations in the separation control region.

49. Dispensable sheet material having opposite side edgeses spaced apart from one another to define the overall width of the sheet material, the sheet material comprising:

a plurality of zones of weakness spaced along the sheet material, the zones of weakness comprising a plurality of perforations and frangible sheet material portions, wherein the frangible sheet material portions in a separation initiation region of the sheet material are narrower and greater in frequency than the frangible sheet material portions in a separation control region of the sheet material, and wherein the width of each of a plurality of perforations in the separation initiation region is less than the width of each of a plurality of perforations in the separation control region.

50. The sheet material of claim 49, wherein the separation initiation region is near at least one of the edgeses of the sheet material.

51. The sheet material of claim 49, wherein one separation initiation region is near one of the edgeses of the sheet material and another separation initiation region is near another one of the edgeses of the sheet material.

52. The sheet material of claim 49, wherein the percent difference between the percent bond of the separation initiation region and the percent bond of the separation control region is less than about 20%.

53. The sheet material of claim 52, wherein the percent difference is less than about 10%.

54. A sheet material dispensing system comprising:

a dispenser defining an interior and an outlet for allowing sheet material to be dispensed from the interior of the dispenser; and the sheet material of claim 49, wherein the sheet material is in the interior of the dispenser.

55. The system of claim 54, wherein the width of the outlet is less than the overall width of the sheet material.

56. The system of claim 55, wherein the dispenser defines a nip, and wherein the sheet material passes through the nip.

57. The system of claim 54, wherein the dispenser defines a nip, and wherein the sheet material passes through the nip.

58. A sheet material dispensing system comprising:

a dispenser defining an interior and an outlet for allowing sheet material to be dispensed from the interior of the dispenser; and dispensable sheet material having opposite side edgeses spaced apart from one another to define the overall width of the sheet material, the sheet material comprising a plurality of zones of weakness spaced along the sheet material, the zones of weakness comprising a plurality of perforations and frangible sheet material portions, wherein above 20% of each of the zones of weakness comprises frangible sheet material portions narrower and greater in frequency than the frangible sheet material portions in the remainder of each of the zones of weakness, wherein the percent difference between the percent bond of a separation initiation region of the sheet material and the percent bond of a separation control region of the sheet mater is less than about 20%, and wherein the sheet material is in the interior of the dispenser.

59. The system of claim 58, wherein the width of the outlet is less than the overall width of the sheet material.

60. The system of claim 59, wherein the dispenser defines a nip, and wherein the sheet material passes through the nip.

61. The system of claim 58, wherein the dispenser defines a nip, and wherein the sheet material passes through the nip.

62. A sheet material dispensing system comprising:

a dispenser defining an interior and an outlet for allowing sheet material to be dispensed from the interior of the dispenser; and dispensable sheet material having opposite side edgeses spaced apart from one another to define the overall width of the sheet material, the sheet material comprising a plurality of zones of weakness spaced along the sheet material, the zones of weakness comprising a plurality of perforations and frangible sheet material portions, wherein the collective center of the centers of gravity of the frangible sheet material portions on at least one side of the center line of the sheet material is substantially closer to a separation initiation region of the sheet material than to a separation control region of the sheet material, wherein the percent difference between the percent bond of the separation initiation region and the percent bond of the separation control region is less than about 20%, and wherein the sheet material is in the interior of the dispenser.

63. The system of claim 62, wherein the width of the outlet is less than the overall width of the sheet material.

64. The system of claim 63, wherein the dispenser defines a nip, and wherein the sheet material passes through the nip.

65. The system of claim 62, wherein the dispenser defines a nip, and wherein the sheet material passes through the nip.

66. A sheet material dispensing system comprising:

a dispenser defining an interior and an outlet for allowing sheet material to be dispensed from the interior of the dispenser; and dispensable sheet material having opposite side edgeses spaced apart from one another to define the overall width of the sheet material, the sheet material comprising:

a plurality of zones of weakness spaced along the sheet material, the zones of weakness comprising a plurality of perforations and frangible sheet material portions, wherein the frangible sheet material portions in a separation initiation region of the sheet material are narrower and greater in frequency than the frangible sheet material portions in a separation control region of the sheet material, wherein the percent difference between the percent bond of the separation initiation region and the percent bond of the separation control region is less than about 20%, and wherein the sheet material is in the interior of the dispenser.

67. The system of claim 66, wherein the width of the outlet is less than the overall width of the sheet material.

68. The system of claim 67, wherein the dispenser defines a nip, and wherein the sheet material passes through the nip.

69. The system of claim 66, wherein the dispenser defines a nip, and wherein the sheet material passes through the nip.

* * * * *

UNITED STATES PATENT AND TRADEMARK OFFICE

CERTIFICATE OF CORRECTION

PATENT NO. : 6,447,864 B2
DATED : September 10, 2002
INVENTOR(S) : Douglas W. Johnson et al.

It is certified that error appears in the above-identified patent and that said Letters Patent is hereby corrected as shown below:

Column 18,
Lines 11, 14, 28, 33, 48 and 66, please change “edgeses” to -- edges --.
Line 20, after “region” insert -- of --.
Line 61, please change “claims” to -- claim --.

Column 19,
Lines 2, 25, 55 and 58, please change “edgeses” to -- edges --.
Line 25, please change “other” to -- another --.

Column 20,
Line 18, please change “edgeses space” to -- edges spaced --.
Line 31, please change “matinee” to -- material --.
Lines 37 and 55, please change “edgeses” to -- edges --.

Column 21,
Lines 6, 20, 23, 25 and 49, please change “edgeses” to -- edges --.
Line 63, please change “mater” to -- material --.

Column 22,
Lines 11 and 41, please change “edgeses” to -- edges --.

Signed and Sealed this

Thirty-first Day of December, 2002

JAMES E. ROGAN
*Director of the United States Patent and Trademark Office*